US007284716B2

(12) United States Patent
Nakano et al.

(10) Patent No.: US 7,284,716 B2
(45) Date of Patent: Oct. 23, 2007

(54) AGITATING DEVICE, AND DISPERSING APPARATUS USING THE AGITATING DEVICE

(75) Inventors: Mitsuru Nakano, Famiruhaitsu-Sakai II-bankan 718, 116-1 Kaisan-cho 2-cho, Sakai-shi, Osaka (JP) 590-0982; Shoji Fukushima, Kobe (JP); Hisashi Kimura, Osaka (JP)

(73) Assignee: Mitsuru Nakano, Osaka (JP)

( * ) Notice: Subject to any disclaimer, the term of this patent is extended or adjusted under 35 U.S.C. 154(b) by 170 days.

(21) Appl. No.: 10/513,440

(22) PCT Filed: Jun. 5, 2003

(86) PCT No.: PCT/JP03/07109

§ 371 (c)(1),
(2), (4) Date: Jun. 21, 2005

(87) PCT Pub. No.: WO03/103819

PCT Pub. Date: Dec. 18, 2003

(65) Prior Publication Data

US 2005/0242218 A1 Nov. 3, 2005

(30) Foreign Application Priority Data

Jun. 5, 2002 (JP) ..... 2002-164671

(51) Int. Cl.
*B02C 23/36* (2006.01)

(52) U.S. Cl. ..... 241/46.17; 241/74

(58) Field of Classification Search .. 241/46.01–46.15, 241/74

See application file for complete search history.

(56) References Cited

U.S. PATENT DOCUMENTS

| | | | |
|---|---|---|---|
| 2,578,805 | A | 12/1951 | Johnson |
| 4,008,882 | A | 2/1977 | Jorgensen |

FOREIGN PATENT DOCUMENTS

| | | |
|---|---|---|
| CH | 359 346 | 12/1961 |
| DE | 28 23 238 | 10/1979 |
| GB | 638 966 | 6/1950 |
| JP | 48-33103 | 10/1973 |
| JP | 51-4653 | 1/1976 |
| JP | 57-45331 | 3/1982 |
| JP | 2002-154923 | 5/2002 |
| NL | 1 008 622 | 9/1999 |

*Primary Examiner*—Mark Rosenbaum
(74) *Attorney, Agent, or Firm*—Hamre, Schumann, Mueller & Larson, P.C.

(57) ABSTRACT

Disclosed is an agitating device (3) to be disposed in a batch-type vessel or the like. The agitating device (3) has an upper cover plate (5), a bottom cover plate (6), an impeller (7), an inner screen member (8), and first and second outer screen members (9, 10). When a mixed liquid including a dispersoid and a dispersion medium passes through liquid communication holes (19) of the inner screen member (8) and liquid communication holes (22, 25) of the outer screen members (9, 10) during the course where it flows outward from the impeller (7) to get out of an interplate space, the circumferential component of the flow vector of the mixed liquid is mostly eliminated to allow the mixed liquid to have substantially only the radial component. This prevents the generation of vortexes so as to apply a sufficiently high shearing force to the mixed liquid to effectively prevent the formation of macro bubbles in the mixed liquid.

5 Claims, 19 Drawing Sheets

SAMPLE 1 (X100)

SAMPLE 1 (X400)

SAMPLE 2 (X100)

SAMPLE 2 (X400)

SAMPLE 4 (X100)

SAMPLE 4 (X400)

SAMPLE 5 (X100)

SAMPLE 5 (X400)

SAMPLE 6 (X100)

SAMPLE 6 (X400)

SAMPLE 8 (X100)

SAMPLE 8 (X400)

SAMPLE 9 (X100)

SAMPLE 9 (X400)

SAMPLE 10 (X100)

SAMPLE 10 (X400)

SAMPLE 11 (X100)

SAMPLE 11 (X400)

SAMPLE 12 (X100)

SAMPLE 12 (X400)

AGITATING DEVICE, AND DISPERSING APPARATUS USING THE AGITATING DEVICE

TECHNICAL FIELD

The present invention relates to an agitating device including a rotary impeller and a plurality of screen members arranged in a multi-stage manner to prevent the generation of vortexes. The present invention also relates to a dispersing apparatus, such as a homogenizer, designed to disperse a dispersoid into a dispersion medium using the agitating device so as to form a dispersed system.

BACKGROUND ART

There has been well known a dispersing apparatus designed to agitate or stir a mixture including a liquid or solid dispersoid and a liquid dispersion medium (the mixture will hereinafter be referred to as "dispersion-material mixture"), at a high speed using a rotary-type agitating device, so as to disperse the dispersoid into the dispersion medium through means of a shearing force to form a dispersed system, such as emulsion (emulsified liquid) or suspension (suspension liquid) (the dispersing apparatus will hereinafter be referred to as "high-speed dispersing apparatus"). In this dispersed-system forming process, a surface-active agent or surfactant is generally added into the dispersion-material mixture to facilitate the dispersion of the dispersoid in the dispersion medium or to stabilize the dispersed system.

In the dispersed-system forming process, a higher dispersity (dispersibility) of the dispersoid in the dispersion medium can be obtained as the surfactant is added at a greater amount, and the agitating device applies a higher shearing force to the dispersion-material mixture. That is, in cases where it is intended to achieve a given dispersibility, a greater addition amount of surfactant allows the intended dispersibility to be achieved by a lower shearing force, and a less addition amount of surfactant raises the need for achieving the intended dispersibility by a higher shearing force.

Generally, in view of the quality of a dispersed system, it is desired to minimize the amount of surfactant to be included in the dispersed system. Moreover, in the dispersed-system forming process using a surfactant, the resulting waste products, such as wastewater, inevitably containing a part of the surfactant involves difficulties in being purified through typical wastewater treating techniques, such as an activated sludge method. Therefore, there is the need for minimizing the addition amount of surfactant in the dispersed-system forming process.

As a measure for meeting this need, it is conceivable to drastically increase the speed of an impeller in an agitating device so as to provide a higher shearing force to be applied to a dispersion-material mixture to reduce the addition amount of surfactant. However, the conventional high-speed dispersing apparatus has a problem that while a shearing force can be increased up to a given level by increasing the speed of the impeller, it will not be appropriately increased beyond the given level despite the increase of the impeller speed. This phenomenon would occur for the reason that when the impeller speed is increased beyond a given threshold value, the dispersion-material mixture contained in a vessel starts rotating integrally with the impeller in its entirety to thereby cause difficulties in the collision between the dispersed-system-material mixture and the inner wall of the vessel.

DISCLOSURE OF INVENTION

Through various experimental tests, the inventors of this application found the fact that in an open-to-atmosphere type (particularly, batch type) high-speed dispersing apparatus, vortexes are generated in a dispersion-material mixture in conjunction with the increase of the speed of an impeller of an agitating device, and the generated vortexes induce the dispersion-material mixture to suck atmospheric air to form relatively large air-bubbles (hereinafter referred to as "macro bubbles") in the dispersion-material mixture, so that the dispersity of a dispersoid in a dispersion medium is deteriorated due to the macro bubbles.

In view of the aforementioned conventional problems and the above experimental result, it is an object of the present invention to provide an agitating device capable of applying a sufficiently high shearing force to a dispersion-material mixture during the process of dispersing a dispersoid into a dispersion medium to form a dispersed system, or to provide a dispersing apparatus using such an agitating device.

It is another object of the present invention to provide an agitating device capable of effectively preventing the formation of macro bubbles in a dispersion-material mixture during the process of forming a dispersed system under an open-to-atmosphere condition, or to provide a dispersing apparatus using such an agitating device.

In order to achieve the above objects, the present invention provides an agitating device including the following elements, (i) a first cover plate having a liquid inlet hole, (ii) a second cover plate disposed at a position spaced apart from the first cover plate in a direction orthogonal to the spreading surface of the first cover plate (in the thickness direction of the first cover plate), (iii) a rotary impeller disposed at a position corresponding to the liquid inlet hole (for example, disposed in such a manner as to allow the center of the liquid inlet hole to be aligned with a rotation shaft (or the rotation axis) of the impeller) in an interplate space defined between the first and second cover plates, (iv) a approximately tube-shaped or tub-shaped inner screen member disposed in the interplate space to surround the impeller and formed with a plurality (a number) of liquid communication holes in the peripheral wall thereof, and (v) on or more (for example, two) generally tube-shaped outer screen member disposed in the interplate space to surround the inner screen member and formed with a plurality (a number) of liquid communication holes in the peripheral wall thereof.

In the agitating device of the present invention, the respective peripheral walls of the inner and outer screen members may have a cylindrical shape.

When the impeller is rotated after the agitating device is immersed in a liquid, the liquid flows in a direction approximately orthogonal to the spreading surface of the first cover plate through the liquid inlet hole to get in the interplate space, and then flows in a direction approximately parallel to the spreading surface of the first cover plate (in an outward direction) through the liquid communication holes of the inner screen member and the liquid communication holes of the outer screen member to get out of the interplate space. When the liquid passes through the liquid communication holes of the inner screen member and the liquid communication holes of the outer screen member during the course where it flows outward from the impeller to get out of the interplate space, the circumferential component of the flow vector of the liquid is mostly eliminated to allow the liquid to have substantially only the radial component. That is, the liquid flows out of the interplate space radially outward in a radial pattern.

Thus, no vortex is generated in the liquid. Therefore, even if the speed of the impeller is increased, the liquid is strongly brought into collision with the inner surface of the vessel so that a high shearing force can be applied to the liquid to provide enhanced dispersity of a dispersoid in a dispersion medium (to reduce the particle diameter of the dispersoid).

In addition, even if this agitating device is disposed in a vessel opened to the atmosphere (or open-to-atmosphere type vessel), no air will not be sucked into the liquid to prevent the formation of macro bubbles therein, because no vortex is generated during agitating of the liquid using the agitating device. Thus, in cases where this agitating device is used in an open-to-atmosphere type high-speed dispersing apparatus, the formation of macro bubbles in the liquid or dispersion-material mixture can be prevented to provide further enhanced dispersity of the dispersoid in the dispersion medium.

The present invention also provides a batch-type dispersing apparatus using the above agitating device. Specifically, in this dispersing apparatus, the agitating device is disposed in an open-to-atmosphere batch-type vessel adapted to stock a mixture including a dispersoid and a dispersion medium. The dispersing apparatus is operable to agitate the mixture stocked in the vessel using the agitating device so as to disperse the dispersoid into the dispersion medium to form a dispersed system.

In this batch-type dispersing apparatus, no vortex is generated in the dispersion-material mixture during agitating. Thus, a higher shearing force can be applied to the dispersion-material mixture in proportion to the increase in impeller speed of the agitating device to provide enhanced dispersity of the dispersoid in the dispersion medium. In addition, no vortex is generated in the dispersion-material mixture during agitating so as to prevent air from being sucked into the dispersion-material mixture to suppress the generation of macro babbles in the dispersion-material mixture. This makes it possible to provide further enhanced dispersity of the dispersoid in the dispersion medium.

The present invention further provides a continuous-type dispersing apparatus using the above agitating device. Specifically, in this dispersing apparatus, the agitating device is disposed in a closed flow-type vessel adapted to allow a mixture including a dispersoid and a dispersion medium to flow therethrough. The dispersing apparatus is operable to agitate the mixture flowing through the vessel so as to disperse the dispersoid into the dispersion medium to form a dispersed system.

In this continuous-type dispersing apparatus, no vortex is generated in the dispersion-material mixture during agitating. Thus, a higher shearing force can be applied to the dispersion-material mixture in proportion to the increase in impeller speed of the agitating device to provide enhanced dispersity of the dispersoid in the dispersion medium.

In the above batch-type or continuous-type dispersing apparatus, when the dispersion medium is a liquid, and the dispersoid is a liquid insoluble in the dispersion medium, the dispersing apparatus serves as a homogenizer (emulsifier or emulsifying apparatus) for forming an emulsion (emulsified liquid). Otherwise, when the dispersion medium is a liquid, and the dispersoid is a solid insoluble in the dispersion medium, the dispersing apparatus serves as an apparatus for forming a suspension (suspension liquid).

For example, the dispersing apparatus or homogenizer using the agitating device of the present invention can be used for the following purposes.

(1) For the purpose of homogenization, anti-oxidation or stability maintenance in dairy products, such as raw milk, cow milk, special cow milk, sterilized goat milk, raw ewe milk, partially-skimmed milk, skimmed or non-fat milk, or processed milk.

(2) For the purpose of homogenization, anti-oxidation, stability maintenance, surface-activation or addition of a carrier function in lecithin.

(3) For the purpose of homogenization, anti-oxidation, stability maintenance or surface-activation in eggs.

(4) For the purpose of homogenization, anti-oxidation or stability maintenance in plant oils.

Further, the dispersing apparatus or homogenizer can form an emulsion of a liquid fatty material and a polysaccharide or protein to obtain a new function. For example, the function includes a function of preventing the oxidation of a fatty material, a function of maintaining the stability of an emulsion, a function of synthesizing an edible surfactant and a carrier function.

Furthermore, the dispersing apparatus or homogenizer can be used to produce pigment, latex, lotion, medicinal agent, solvent for resins, additive, pharmaceutical fine-particle dispersed system (drug carrier), juice, condiment, edible emulsifying agent, emulsified food, COM (Coal Oil Mixture), CWM (Coal Water Mixture), wax, storage or memory material (magnetic paint, magnetic recording medium), lubricant agent, flocculant or coagulant, grease, ink, paint or coating material, soap, or cleanser or detergent.

BRIEF DESCRIPTION OF DRAWINGS

A better understanding of the present invention can be obtained when the following detailed description is considered in conjunction with the accompanying drawings, in which:

FIGS. 3A and 3B show an inner screen member of the agitating device in FIGS. 2A and 2B, wherein FIGS. 3A and 3B are a top plan view and a partial sectional front view thereof, respectively;

FIGS. 4A and 4B show a first outer screen member of the agitating device in FIGS. 2A and 2B, wherein FIGS. 4A and 4B are a sectional top plan view and a partial sectional front view thereof, respectively;

FIGS. 5A and 5B show a second outer screen member of the agitating device in FIGS. 2A and 2B, wherein FIGS. 5A and 5B are a sectional top plan view and a partial sectional front view thereof, respectively;

FIGS. 6A and 6B show an impeller of the agitating device in FIGS. 2A and 2B, wherein FIGS. 6A and 6B are a top plan view and a partial sectional front view thereof, respectively;

BEST MODE FOR CARRYING OUT THE INVENTION

An embodiment of the present invention will now be specifically described.

Figure 1A:
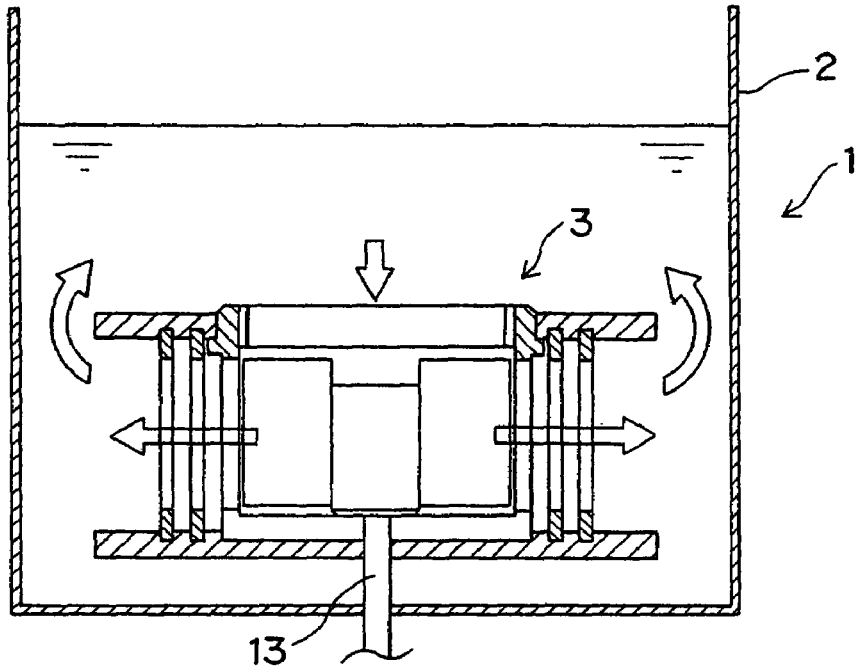
FIG. 1A is a vertical sectional view of a batch-type homogenizer using an agitating device disposed in a batch-type vessel, according to one embodiment of the present invention.

As shown in FIG. 1A, a batch-type homogenizer 1 (high-speed dispersing apparatus) substantially includes a batch-type vessel 2 opened to the atmosphere (or open-to-atmosphere batch-type vessel), and an agitating (stirring) device 3 disposed in the batch-type vessel 2 (at a position adjacent to the bottom thereof). The structure and function of the agitating device 3 will be specifically described later. The homogenizer 1 is designed to stock in the batch-type vessel 2 a mixed material liquid (dispersion-material mixture) including a liquid dispersoid and a liquid dispersion medium which are insoluble in one another, and agitate the stocked mixed material liquid at a high speed using the agitating device 3 so as to disperse the dispersoid into the dispersion medium to form an emulsion (dispersed system). The arrows in FIG. 1A indicate general flow directions of the mixed material liquid.

Figure 1B:
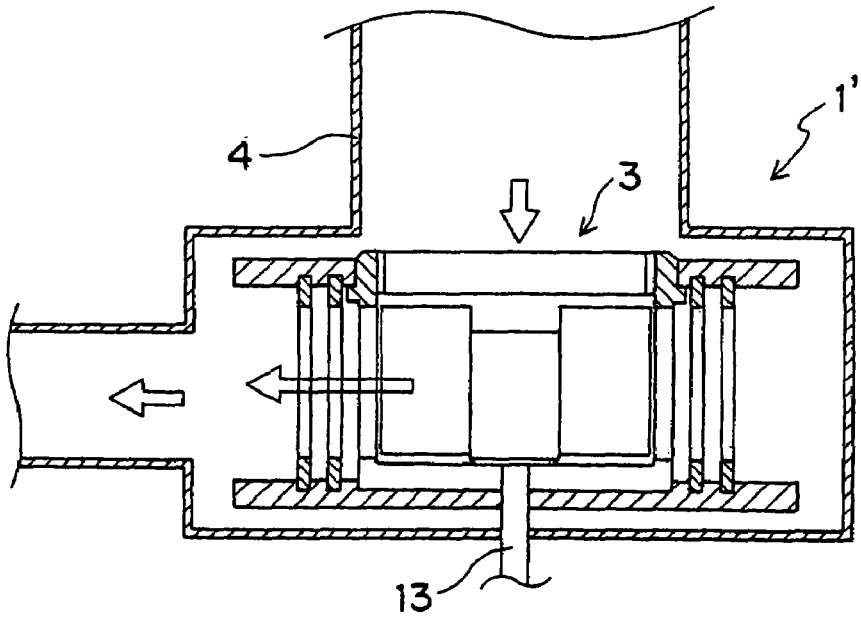
FIG. 1B is a vertical sectional view of a continuous-type homogenizer using the agitating device disposed in a closed flow-type vessel.
Figure 2A:
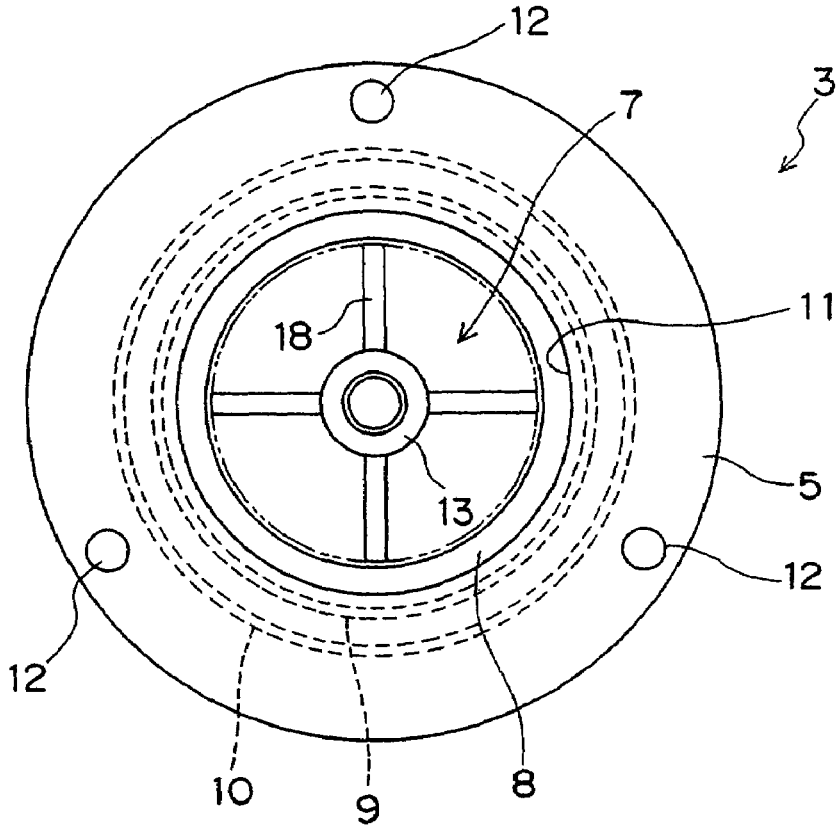
FIGS. 2A and 2B are a top plan view and a vertical sectional view of the agitating device, respectively.
Figure 2B:
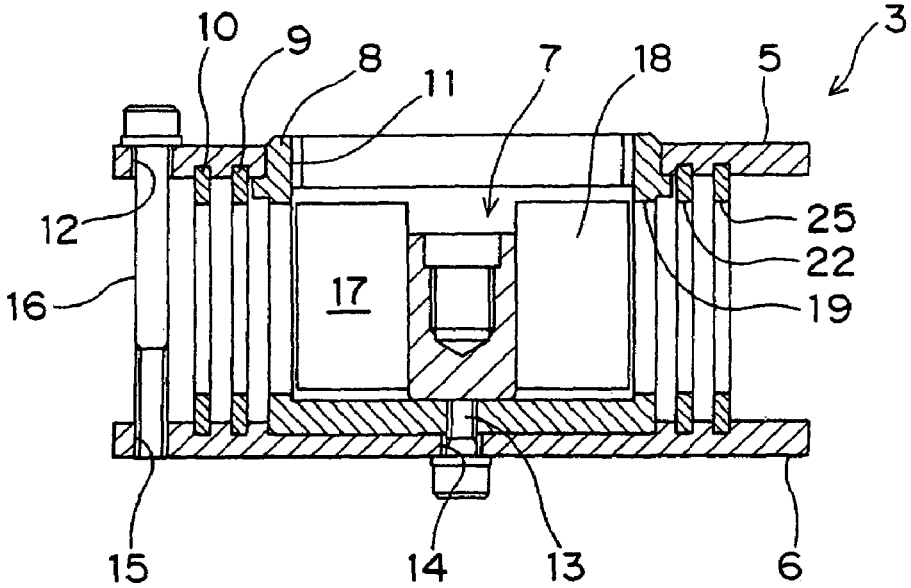
Figure 3A:
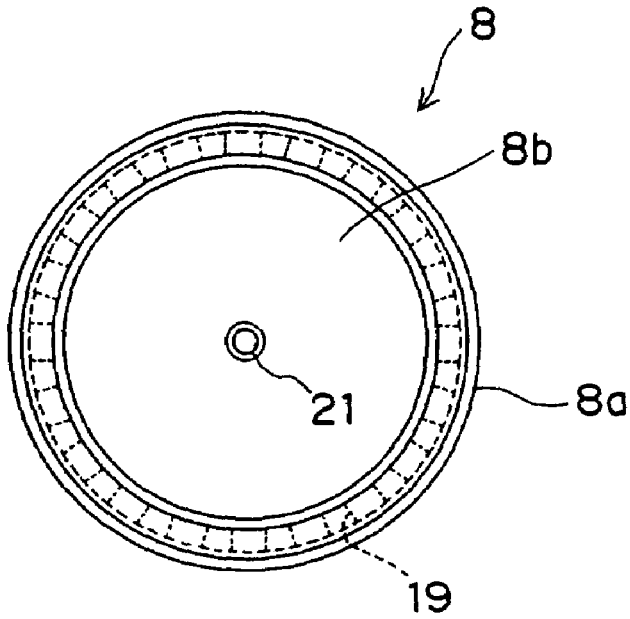
Figure 3B:
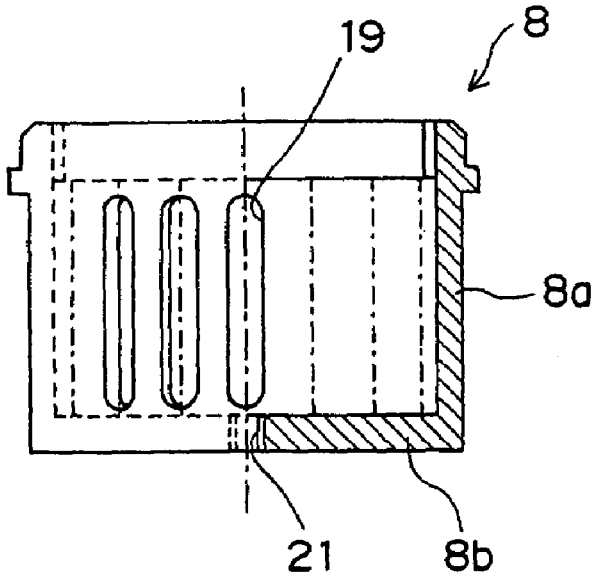
Figure 4A:
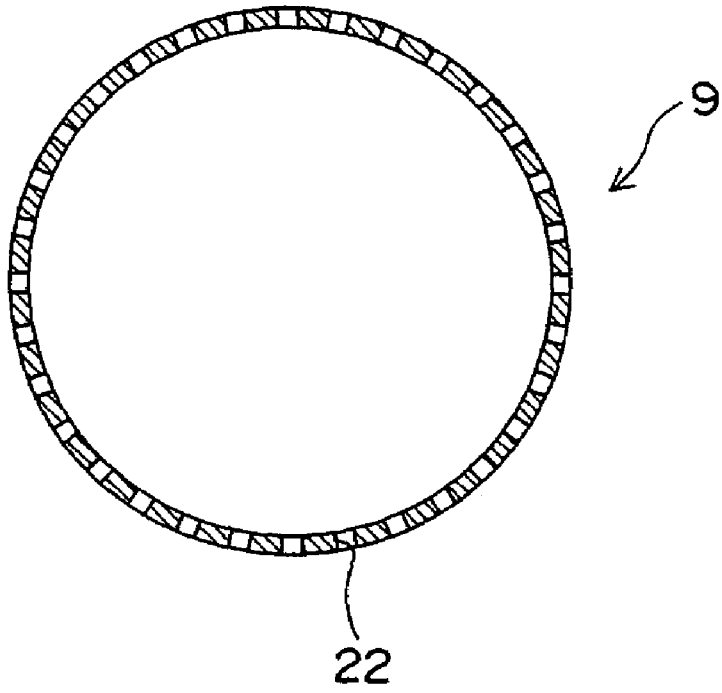
Figure 4B:
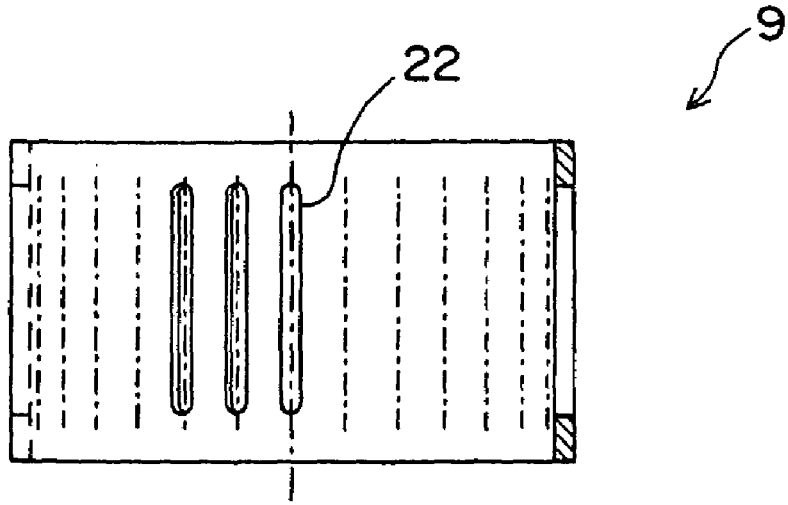
Figure 5A:
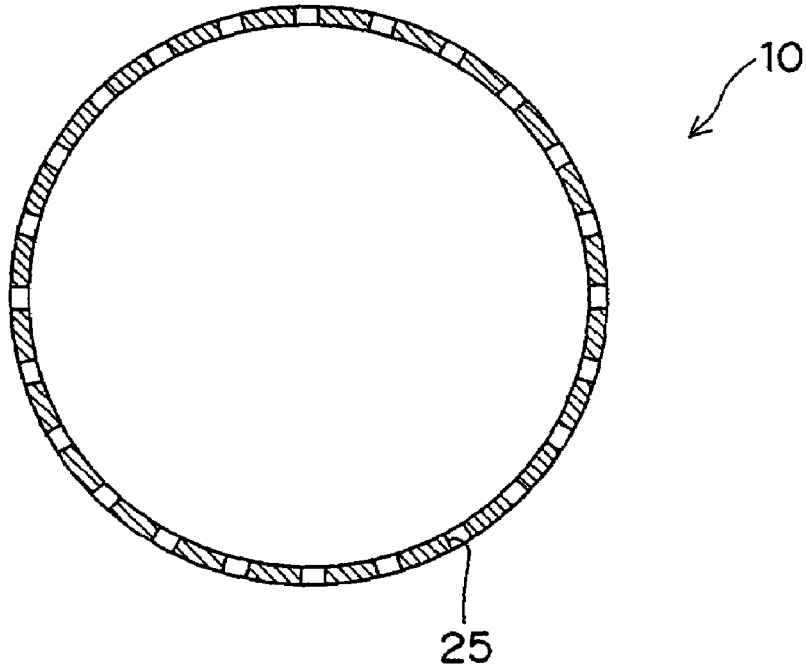
Figure 5B:
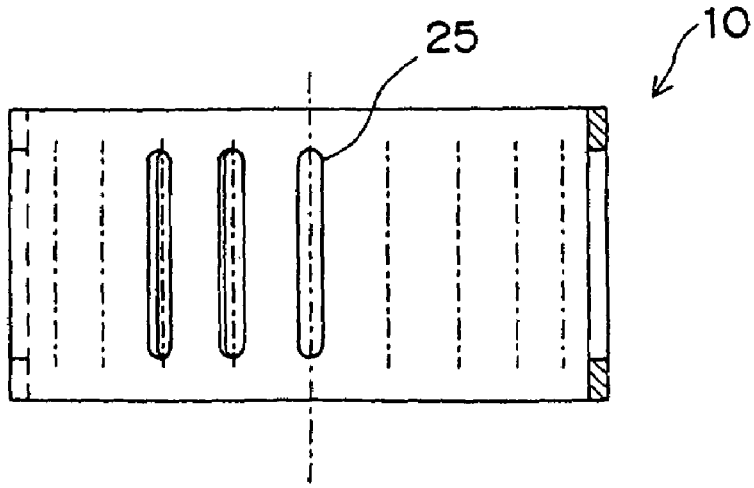
Figure 6A:
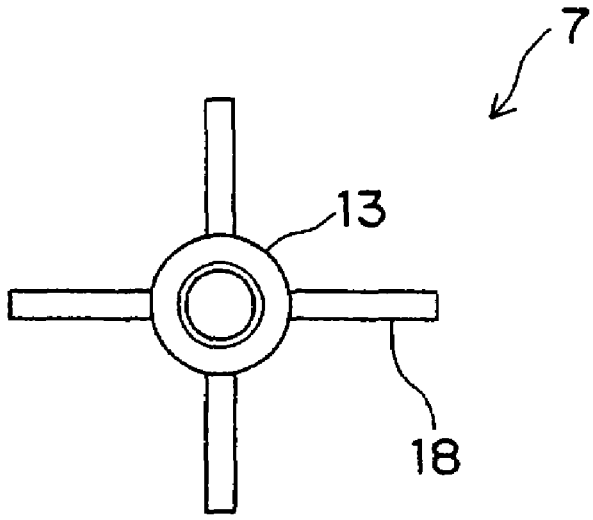
Figure 6B:
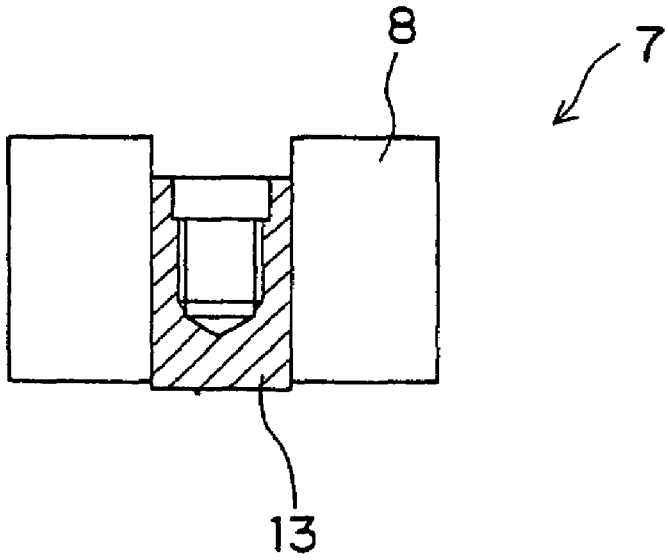
Figure 7A:
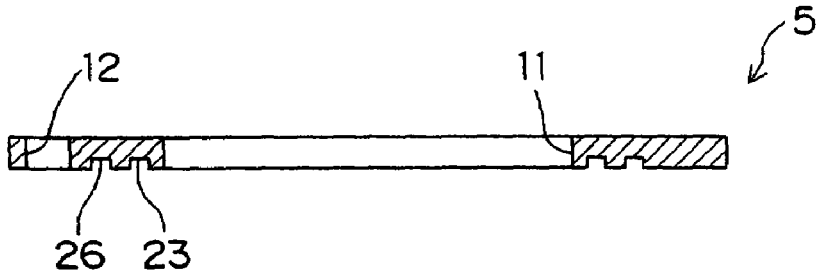
FIG. 7A is a sectional front view of an upper cover plate of the agitating device in FIGS. 2A and 2B.
Figure 7B:
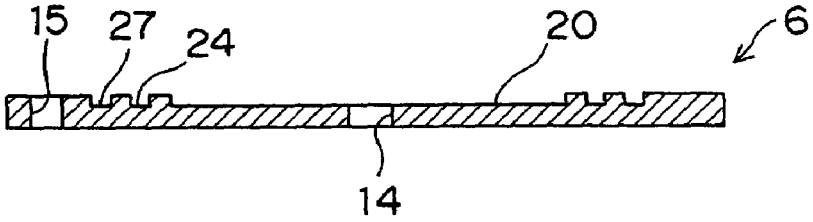
FIG. 7B is a sectional front view of a lower cover plate of the agitating device in FIGS. 2A and 2B.

In a closed continuous-type (in-line type) homogenizer 1' as shown in FIG. 1B, the agitating device 3 is disposed in a flow-type vessel 4 closed to the atmosphere (or closed flow-type vessel). In this case, the homogenizer 1' is designed to allow the mixed material liquid to flow through the vessel 4, and agitate the mixed material liquid at a high speed using the agitating device 3 so as to disperse the dispersoid into the dispersion medium to form an emulsion. The arrows in FIG. 1B indicate general flow directions of the mixed material liquid.

The structure and function of the agitating device 3 will be specifically described below.

As shown in FIGS. 2A to 7B, the agitating device 3 comprises an upper cover plate (first cover plate) 5, a bottom cover plate (second cover plate) 6, an impeller 7, an inner screen member 8, a first outer screen member 9, and a second screen member 10.

The upper cover plate 5 has a disc shape. The upper cover plate 5 is formed with a circular-shaped liquid inlet hole 11 (having a diameter slightly greater than that of the impeller 7) in the approximately central region thereof, and three bolt-holes 12 around the peripheral edge thereof. The bottom cover plate 6 is a disk-shaped member having the same outer diameter as that of the upper cover plate 5. The bottom cover plate 6 is formed with a shaft-hole 14 for penetratingly receiving therein a rotation shaft 13 of the impeller 7, in the central region thereof, and three bolt-holes 15 around the peripheral edge thereof. The upper and bottom cover plates 5, 6 are connected together using three bolts 16 fitted or threadingly inserted into the corresponding bolt-holes 12, 15, so as to be located apart from one another by a given distance in a direction orthogonal to the spreading surface of the upper or bottom cover plate 5, 6 (hereinafter referred to as "spreading plate-surface"). That is, a given interplate space 17 is defined between the upper cover plate 5 and the bottom cover plate 6.

The impeller 7 is a high-speed agitator provided with four paddles (agitating blades) 18 fixed to the rotation shaft 13 and adapted to rotate the paddles 18 at a desired speed through the rotation shaft 13 coupled to a motor (not shown). The impeller 7 is disposed such that the axis of the rotation shaft 13 is aligned with the centerline of the liquid inlet hole 11.

The inner screen member 8 is formed to have a generally tub shape with an inner diameter slightly greater than the diameter of the impeller 7, and disposed in the interplate space 17 to surround the impeller 7. The inner screen member 8 has a cylindrical-shaped peripheral wall 8*a* formed with a number of liquid communication holes 19. The inner screen member 8 also has a bottom wall 8*b* fitted into a columnar-shaped concave portion 20 formed in the bottom cover plate 6. The cylindrical wall 8*a* is fitted into the liquid inlet hole 11 of the upper cover plate 5. In this manner, the inner screen member 8 is fixed at an intended position. The bottom wall 8*b* of the inner screen member 8 is formed with a shaft-hole 21 for penetratingly receiving therein the rotation shaft 13 of the impeller 7.

The first outer screen member 9 is formed to have a generally cylindrical shape with an inner diameter slightly greater than the outer diameter of the inner screen member 8, and disposed in the interplate space 17 to surround the inner screen member 8. The first outer screen member 9 has a cylindrical-shaped peripheral wall formed with a number of liquid communication holes 22. The first outer screen member 9 has an upper end fitted into an annular-shaped groove 23 formed in the upper cover plate 5, and a lower end fitted into an annular-shaped groove 24 formed in the bottom cover plate 6. In this manner, the first outer screen member 9 is fixed at an intended position.

The second outer screen member 10 is formed to have a generally cylindrical shape with an inner diameter slightly greater than the outer diameter of the first outer screen member 9, and disposed in the interplate space 17 to surround the first outer screen member 9. The second outer screen member 10 has a cylindrical-shaped peripheral wall formed with a number of liquid communication holes 25. The second outer screen member 10 has an upper end fitted into an annular-shaped groove 26 formed in the upper cover plate 5, and a lower end fitted into an annular-shaped groove 27 formed in the bottom cover plate 6. In this manner, the second outer screen member 10 is fixed at an intended position.

The operation or function of the agitating device 3 disposed in the batch-type vessel 2, or the homogenizer 1 will be described below.

When the impeller 7 of the agitating device 3 is rotated after a mixed material liquid including a liquid dispersoid and a liquid dispersion medium is stocked in the batch-type vessel 2, the mixed material liquid residing on the upper side of the liquid inlet hole 11 flows downward (in a direction approximately orthogonal to the spreading plate-surface) through the liquid inlet hole 11 to get in the interplate space 17. Simultaneously, the mixed material liquid residing on the inward side of the inner screen member 8 is discharged horizontally (in a direction parallel to the spreading plate-surface) outward by the impeller 7 to get out of the interplate space 17 through the liquid communication holes 19 of the inner screen member 8, the liquid communication holes 22 of the first outer screen member 9, and the liquid communication holes 25 of the second outer screen member 10, in this order.

When the mixed material liquid passes through the liquid communication holes 22, 25 of the first and second outer screen members 9, 10 on the outward side of the inner screen member 8 during the course where it flows outward from the impeller 7 to get out of the interplate space 17, the circumferential component of the flow vector of the mixed material liquid is mostly eliminated to allow the mixed material liquid to have substantially only the radial component.

Figure 8A:
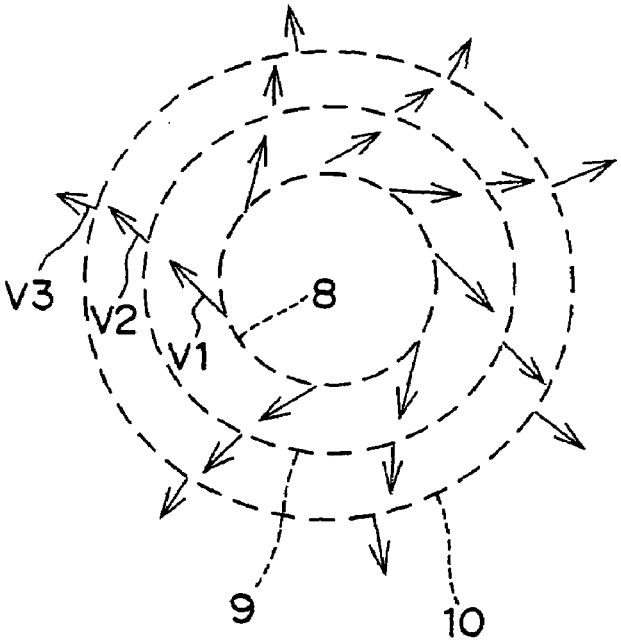
FIG. 8A is a diagram showing the flow vectors of a mixed material liquid agitated by an agitating device having the inner and outer screen members.

FIG. 8A shows the flow vector V1 of the mixed material liquid just after it flows out outward from the liquid communication holes 19 of the inner screen member 8, the flow vector V2 of the mixed material liquid just after it flows out outward from the liquid communication holes 22 of the first outer screen member 9, and the flow vector V3 of the mixed material liquid just after it flows out outward from the liquid communication holes 25 of the second outer screen member 10. As seen in FIG. 8A, while the vector V1 fairly includes a circumferential component, and the vector V2 slightly includes a circumferential component, the vector V3 does not include any circumferential component.

Thus, the mixed material liquid finally getting out of the agitating device 3 without any circumferential component flows radially outward in a radial pattern, and collides with the inner surface of the batch-type vessel 2. This prevents the generation of vortexes in the mixed material liquid.

Figure 8B:
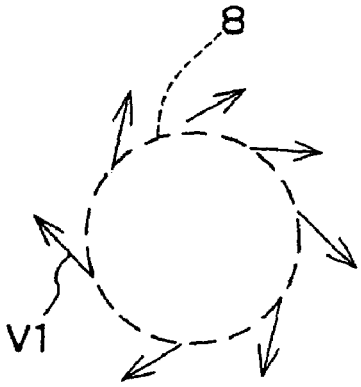
FIG. 8B is a diagram showing the flow vectors of a mixed material liquid agitated by an agitating device having only the inner screen member.

As shown in FIG. 8B, if an agitating device has only the inner screen member 8 without the outer screen members 9, 10, the mixed material liquid finally getting out of the agitating device will have a flow vector including a circumferential component to cause the generation of vortexes.

According to the agitating device 3, a higher shearing force can be applied to the mixed material liquid in proportion to the increase in speed of the impeller 7. That is, the mixed material liquid applied with a sufficiently high shearing force can have enhanced dispersity of the dispersoid in the dispersion medium (can have a reduced particle size of the dispersoid). In addition, the mixed material liquid having no vortex during agitating does not involve the risk of sucking air therein or forming macro bubbles therein. This can provide further enhanced dispersity of the dispersoid in the dispersion medium.

The features of an emulsion prepared using the agitating device 3 or the homogenizer 1 (dispersing apparatus) according to the present invention will be described below while comparing them with the conventional example. The features of the agitating device 3 or the homogenizer 1 according to the present embodiment will also be described below while comparing them with the conventional example.

The agitating device 3 or the open-to-atmosphere batch-type homogenizer 1 according to the present embodiment has a feature of preventing the generation of vortexes to apply a higher shearing force to a mixed material liquid, and preventing the formation of macro bubbles in the mixed material liquid to provide enhanced dispersity of a dispersoid in a dispersion medium.

The following three types of bubbles (cavitation) are generally formed in a homogenizer.

(1) Macro Bubble (Vortex Bubble)

A large bubble to be formed through the phenomenon that vortexes formed by an impeller rotating at a high speed continuously suck a gas phase in contact with fluid.

(2) Micro Bubble (Turbulence Bubble)

A bubble to be introduced from a high-speed rotating body or formed when a high-speed fluid flowing in a line passes through a narrow space. A force for generating turbulence is essentially required. In a high-speed agitating device, the formation of this bubble is dependent on clearance, convergence, and kinematic viscosity coefficient. It will be formed at a peripheral velocity of 10 m/sec or more.

(3) Shock Wave Bubble

An ultrafine bubble including a shock wave, which is formed and vanished in an extremely accelerated fluid (several hundred m/sec) within the range of $1/1000$ to $1/10000000$ sec.

In a high-speed homogenizer, shock wave bubbles are not formed. Thus, the measure is directed to macro bubbles and micro bubbles. As mentioned above, in the conventional agitating device, a mixed material liquid flows in association with the agitating blades, and thereby the flow direction of mixed material liquid orients to the rotation direction of the agitating blades. Thus, if the speed of the impeller is increased, vortexes will be inevitably generated to form macro bubbles. By contrast, in the agitating device 3 or the homogenizer 1 according to the present embodiment, the screen members 8 to 10 arranged in multistage allow the mixed material liquid to be discharged radially in a radial pattern so as to prevent the generation of vortex. Thus, no macro bubble is formed. Further, in the agitating device 3 or the homogenizer 1 according to the present embodiment, of the liquid communication holes (openings) 19, 22, 25 of the screen members 8 to 10 are formed to prevent the generation of vortexes and control the discharge direction of the mixed material liquid.

Generally, micro bubbles are inevitably formed when a mixed material liquid discharged from an agitating device has turbulences. Thus, the agitating device 3 or the homogenizer 1 according to the present embodiment inevitably involves the generation of micro bubbles, and therefore there is no choice but to use a closed-type homogenizer and increase a pressure (backpressure) for eliminating micro bubbles.

As mentioned above, in an emulsifying process, if the addition amount of surfactant is reduced, a higher shearing force is required to achieve a given dispersity because of the correlation between the addition amount of surfactant and the shearing force. However, if the shearing force is increased, the problem about bubbles will come to the front. Thus, suitable conditions for forming an emulsion have heretofore been determined through a trial and error process, while taking account of the addition amount of surfactant, the shearing force and the problem about bubbles.

In the agitating device 3 or the homogenizer 1 according to the present embodiment, even in case of applying the same level of energy to a mixed material liquid, the shapes and/or the number of the multistage screen members 8 to 10, the shape of the impeller 7 and/or clearances therebetween can be adjusted to consume the energy of the mixed material liquid so as to prevent the generation of turbulences in the mixed material liquid discharged from the agitating device 3 to the batch-type vessel 2. In this case, there is the risk of spoiling the general flow of the mixed material liquid which is required to homogenize the condition of the entire mixed material liquid in the batch-type vessel 2. The level of elimination of micro bubbles is determined by a recipe and/or an intended quality of a final product.

Generally, a high-pressure emulsifying apparatus is a closed-type, and thereby no air is sucked from the atmosphere into a mixed material liquid or no macro bubble is formed. Thus, the dispersity of a dispersoid in a dispersion medium is dependent on micro bubbles and shock wave bubbles. Therefore, if only the formation of micro bubbles is prevented (suppressed), the dispersity of the dispersoid can be effectively enhanced.

By contrast, in a high-speed agitating-type emulsifying apparatus, macro bubbles generally have a greater impact on the dispersity of the dispersoid, and the influence of micro bubbles never comes to the front. From this point of view, the agitating device 3 or the homogenizer 1 according to the present embodiment is designed to prevent the generation of vortexes using the multistage screen members 8 to 10 so as to suppress the formation of macro bubbles to provide enhanced dispersity of the dispersoid.

According to experimentally obtained knowledge of the inventors of this application, macro bubbles have an adverse affect on the dispersion of a dispersoid particle having a particle diameter of 10μ or more. Further, micro bubbles have an adverse affect on the dispersion of a dispersoid particle having a particle diameter of 1 to 10μ, and shock wave bubbles have an adverse affect on the dispersion of a dispersoid particle having a particle diameter of 0.5 to 1μ. Thus, these types of bubbles may be selectively eliminated to facilitate the dispersion of the corresponding dispersoid particles having the above particle diameters. Therefore, the agitating device 3 or the homogenizer 1 according to the present embodiment can be used to facilitate the dispersion of a dispersoid particle having a particle diameter, particularly, of 10μ or more.

The results obtained by preparing emulsion samples using the agitating device 3 or the homogenizer 1 according to the present embodiment, measuring the particle-size distribution (dispersity) of dispersoid particles in each of the samples, and observing the dispersion state of the dispersoid particles in each of the samples will be described below while comparing them with samples prepared using the conventional agitating device or homogenizer.

Eight types of emulsion samples were prepared using a mixed material liquid containing a dispersion medium consisting of purified water, and a dispersoid including 10 wt % of liquid paraffin and 1.2 wt % of polyoxyethylene sorbitan mono-laurate (Tween-based) serving as surfactant (with the balance being purified water). The mixed material liquid for each of the samples was 600 g on an experimental scale, and an emulsification was initiated at 50° C. A processing time was set at 5 or 10 minutes. The particle-size distribution of the dispersoid particles was measured using a dedicated particle size meter (AccuSizer780) capable of measuring a foreign particle of 1μ or more.

Samples 1 to 5 were obtained by subjecting the mixed material liquid to an emulsification using only a high-speed agitating device or a high-speed agitating-type homogenizer. Samples 6 to 8 were obtained by subjecting mixed material liquid to the above emulsification, and then subjecting the obtained emulsion to a single-pass emulsification using a 1000 bar high-pressure emulsifying apparatus.

As comparative examples, Samples 3 and 4 were prepared using a homogenizer constructed by attaching the impeller 7 and the multistage screen members 8 to 10 according to the present embodiment to a conventionally highly evaluated screen-type agitating device. As an additional comparative example, Sample 5 was prepared using the conventional agitating device.

(1) Sample 1

Sample 1 was prepared the following conditions.

Agitating device: the agitating device according to the present embodiment

Agitating speed: 10000 r.p.m.

Load: a rated value (100%)

Processing time: 5 minutes

Figure 9:
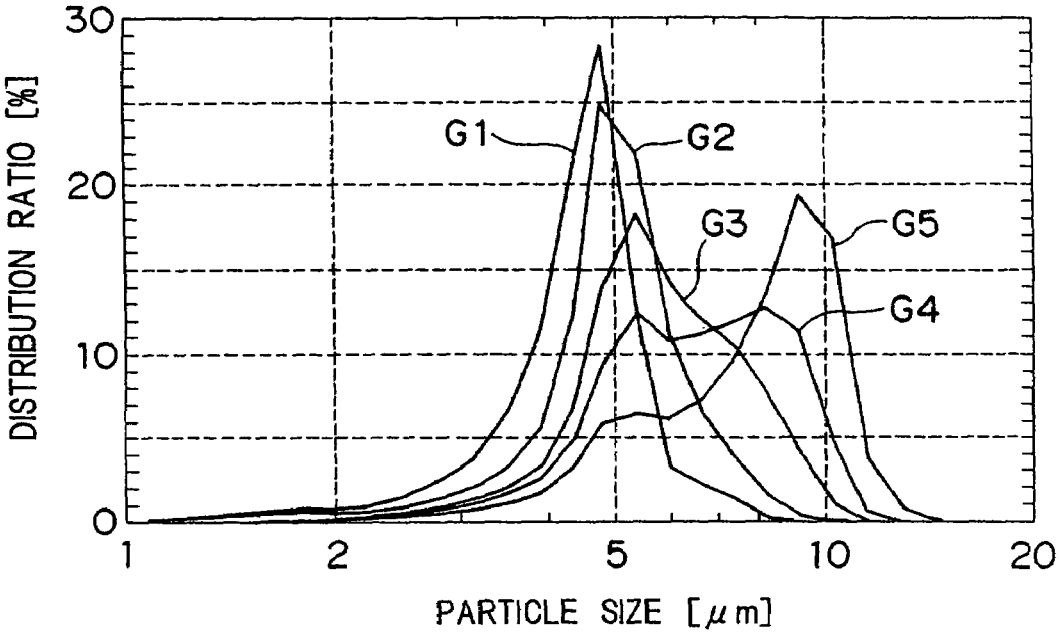
FIG. 9 is a graph showing the particle-size distribution of dispersoid particles in each of emulsions prepared using a high-speed emulsifying apparatus.

The curve G1 in FIG. 9 indicates the particle-size distribution of dispersoid particles in Sample 1. While no macro bubble was formed in Sample 1, micro bubbles were formed therein.

Figure 12A:
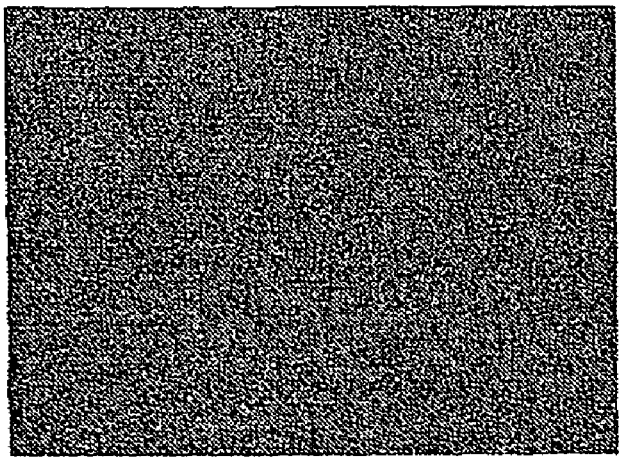
FIGS. 12A and 12B are photographic images of the emulsion indicated by the curve G1 in FIG. 9, taken at 100 and 400 magnifications, respectively.
Figure 12B:
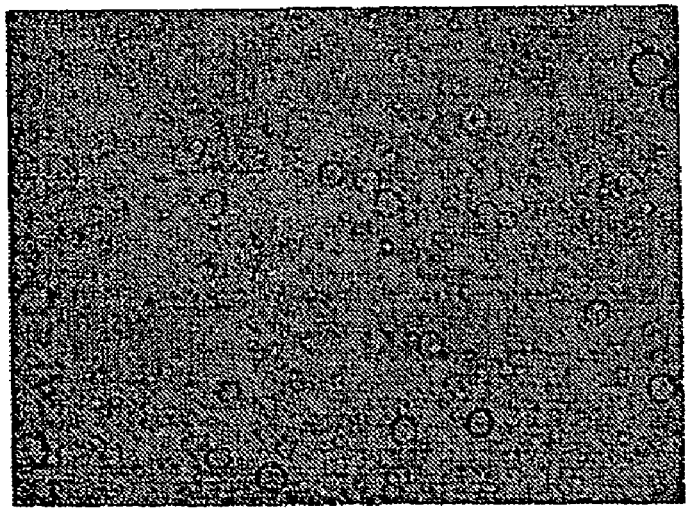

FIGS. 12A and 12B are photographic images of Sample 1 taken at 100 and 400 magnifications, respectively.

(2) Sample 2

Sample 2 was prepared the following conditions.

Agitating device: the agitating device according to the present embodiment

Agitating speed: 7000 r.p.m.

Load: 70% of the rated value

Processing time: 5 minutes

The curve G2 in FIG. 9 indicates the particle-size distribution of dispersoid particles in Sample 2. While no macro bubble was formed in Sample 2, micro bubbles were formed therein.

Figure 13A:
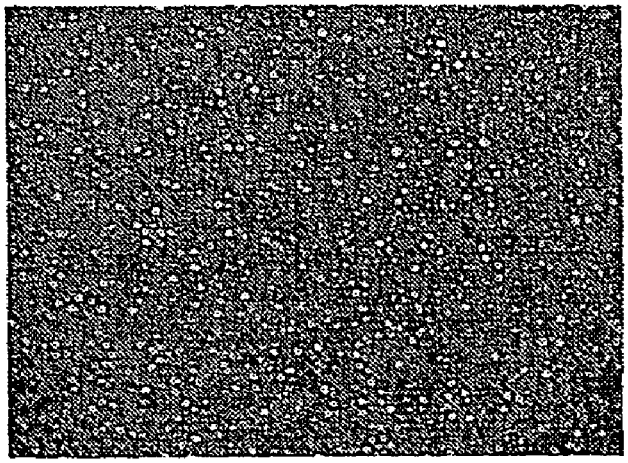
FIGS. 13A and 13B are photographic images of the emulsion indicated by the curve G2 in FIG. 9, taken at 100 and 400 magnifications, respectively.
Figure 13B:
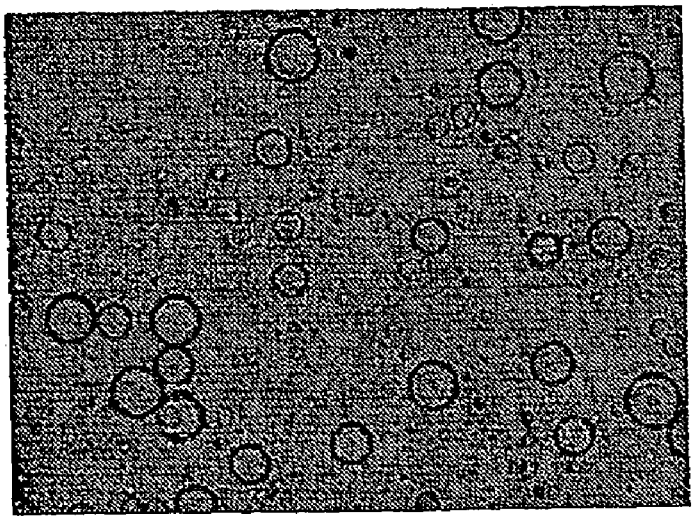

FIGS. 13A and 13B are photographic images of Sample 2 taken at 100 and 400 magnifications, respectively.

(3) Sample 3

Sample 3 was prepared the following conditions.

Agitating device: an agitating device including the blades of the conventional agitator and the multistage screen members according to the present embodiment Agitating speed: 10000 r.p.m.

Load: 60% of the rated value

Processing time: 10 minutes

The curve G3 in FIG. 9 indicates the particle-size distribution of dispersoid particles in Sample 3. Neither macro bubble nor micro bubble was formed in Sample 3.

(4) Sample 4

Sample 4 was prepared the following conditions.

Agitating device: an agitating device comprising the blades of the conventional agitator and the multistage screen members according to the present embodiment Agitating speed: 10000 r.p.m.

Load: 60% of the rated value

Processing time: 5 minutes

The curve G4 in FIG. 9 indicates the particle-size distribution of dispersoid particles in Sample 4. Neither macro bubble nor micro bubble was formed in Sample 4.

Figure 14A:
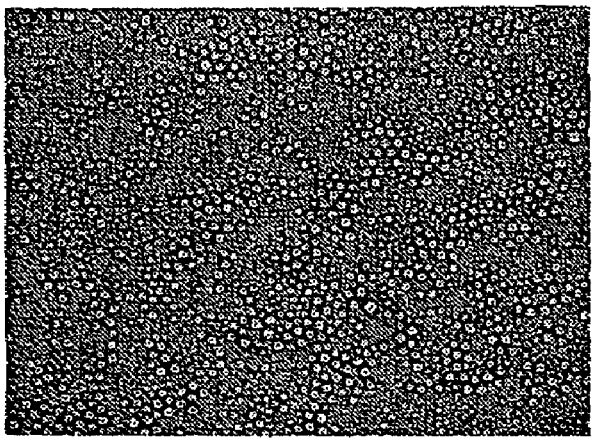
FIGS. 14A and 14B are photographic images of the emulsion indicated by the curve G4 in FIG. 9, taken at 100 and 400 magnifications, respectively.
Figure 14B:
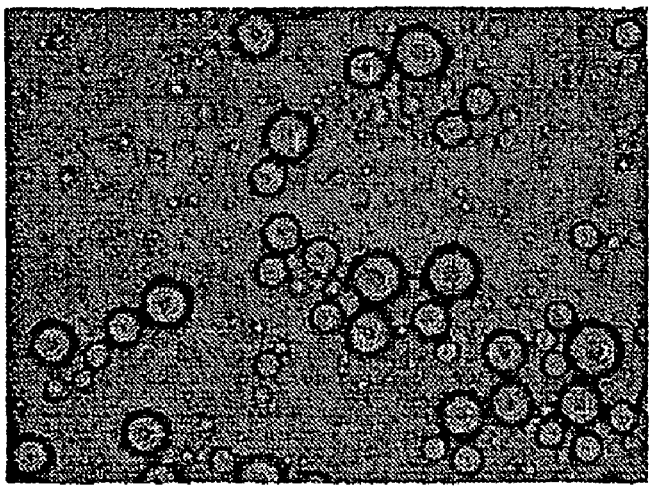

FIGS. 14A and 14B are photographic images of Sample 4 taken at 100 and 400 magnifications, respectively.

(5) Sample 5

Sample 5 was prepared the following conditions.

Agitating device: the conventional agitating device

Agitating speed: 10000 r.p.m.

Load: 70% of the rated value

Processing time: 5 minutes

The curve G5 in FIG. 9 indicates the particle-size distribution of dispersoid particles in Sample 5. Macro bubbles and micro bubbles were formed in Sample 5.

Figure 15A:
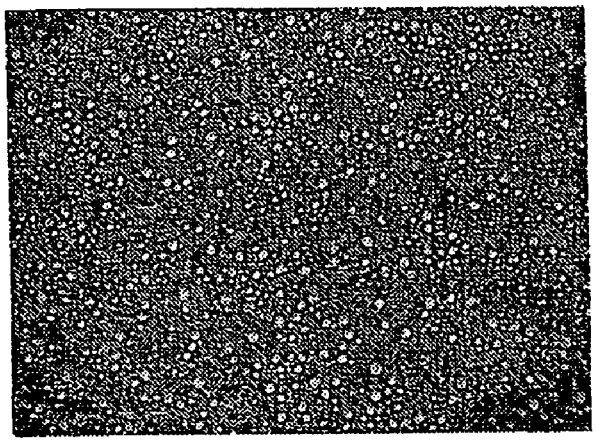
FIGS. 15A and 15B are photographic images of the emulsion indicated by the curve G5 in FIG. 9, taken at 100 and 400 magnifications, respectively.
Figure 15B:
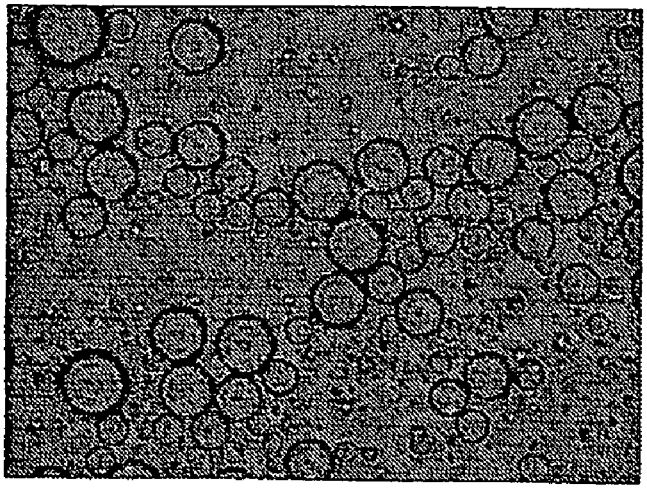

FIGS. 15A and 15B are photographic images of Sample 5 taken at 100 and 400 magnifications, respectively.

(6) Sample 6

Sample 6 was prepared the following conditions.

Agitating device: the agitating device according to the present embodiment

Agitating speed: 10000 r.p.m.

Load: the rated value (100%)

Processing time: 5 minutes

High-pressure emulsification: 1000 bar, 1 pass

Figure 10:
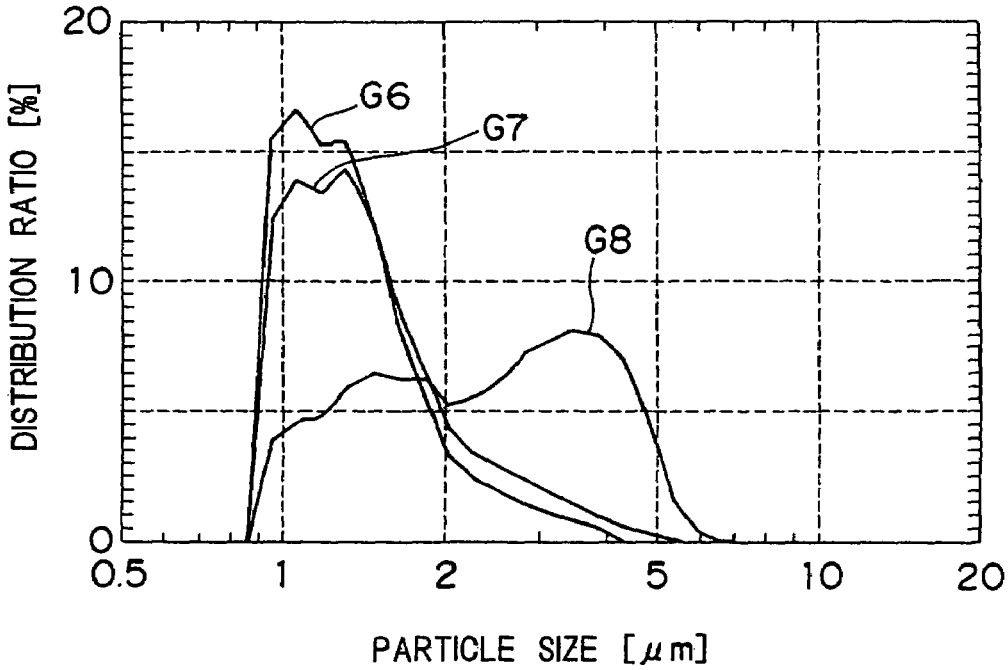
FIG. 10 is a graph showing the particle-size distribution of dispersoid particles in each of emulsions prepared using a high-speed emulsifying apparatus and a high-pressure emulsifying apparatus.

The curve G6 in FIG. 10 indicates the particle-size distribution of dispersoid particles in Sample 6.

Figure 16A:
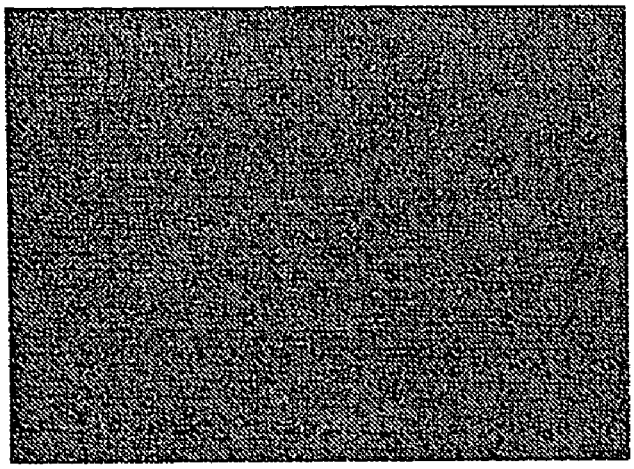
FIGS. 16A and 16B are photographic images of the emulsion indicated by the curve G6 in FIG. 10, taken at 100 and 400 magnifications, respectively.
Figure 16B:
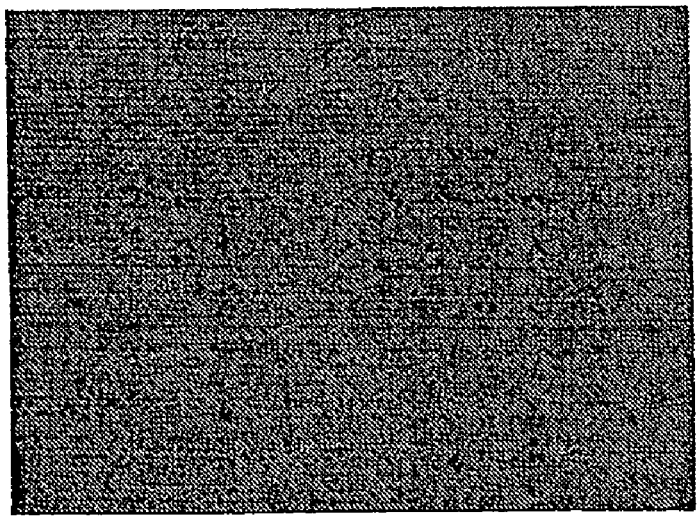

FIGS. 16A and 16B are photographic images of Sample 6 taken at 100 and 400 magnifications, respectively.

(7) Sample 7

Sample 7 was prepared the following conditions.

Agitating device: the agitating device according to the present embodiment

Agitating speed: 7000 r.p.m.

Load: 70% of the rated value

Processing time: 5 minutes

High-pressure emulsification: 1000 bar, 1 pass

The curve G7 in FIG. 10 indicates the particle-size distribution of dispersoid particles in Sample 7.

(8) Sample 8

Sample 8 was prepared the following conditions.

Agitating device: the conventional agitating device

Agitating speed: 10000 r.p.m.

Load: 70% of the rated value

Processing time: 5 minutes

High-pressure emulsification: 1000 bar, 1 pass

The curve G8 in FIG. 10 indicates the particle-size distribution of dispersoid particles in Sample 8.

Figure 17A:
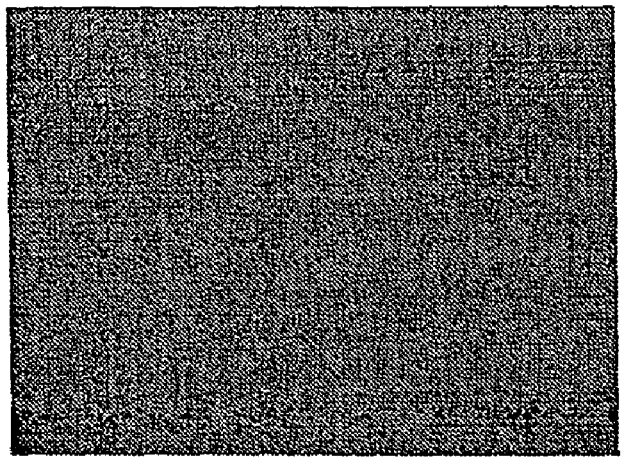
FIGS. 17A and 17B are photographic images of the emulsion indicated by the curve G8 in FIG. 10, taken at 100 and 400 magnifications, respectively.
Figure 17B:
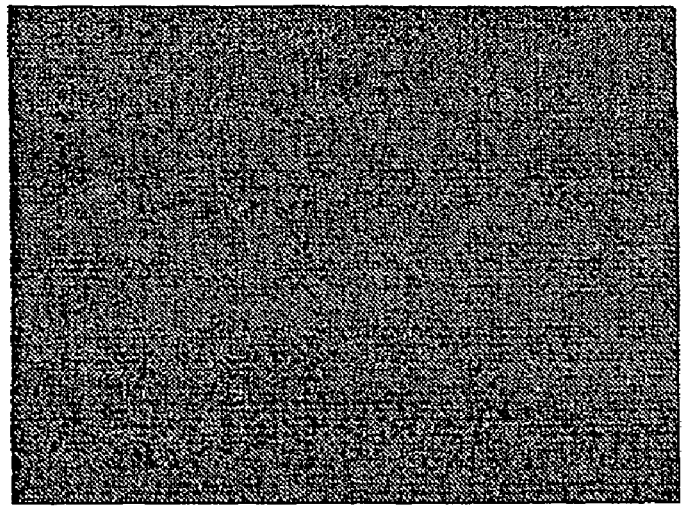

FIGS. 17A and 17B are photographic images of Sample 8 taken at 100 and 400 magnifications, respectively.

Further, under the same conditions as those in Samples 1 to 8 except that a mixed material liquid contained 3.6 wt % of polyoxyethylene sorbitan mono-laurate (Tween-based), the following four kinds of Samples 9 to 12 were prepared. All of Samples 9 to 12 were obtained by subjecting mixed material liquid to an emulsification using only a high-speed agitating device or a high-speed agitating-type homogenizer. As comparative examples, Sample 11 was prepared using the homogenizer constructed by attaching the impeller 7 and the multistage screen members 8 to 10 according to the present embodiment to the conventionally highly evaluated screen-type agitating device. As an additional comparative example, Sample 12 was prepared using the conventional agitating device.

(9) Sample 9

Sample 9 was prepared the following conditions.

Agitating device: the agitating device according to the present embodiment

Agitating speed: 10000 r.p.m.

Load: the rated value (100%)

Processing time: 5 minutes

Figure 11:
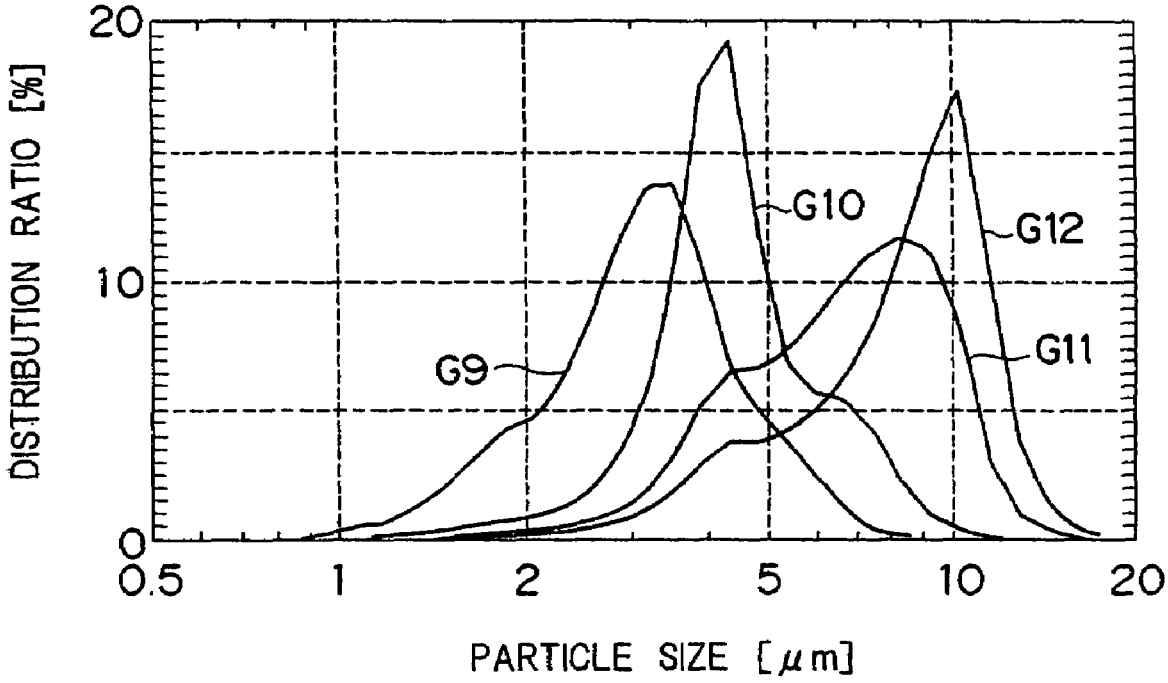
FIG. 11 is a graph showing the particle-size distribution of dispersoid particles in each of emulsions prepared using a high-speed emulsifying apparatus.

The curve G9 in FIG. 11 indicates the particle-size distribution of dispersoid particles in Sample 9. While no macro bubble was formed in Sample 9, micro bubbles were formed therein.

Figure 18A:
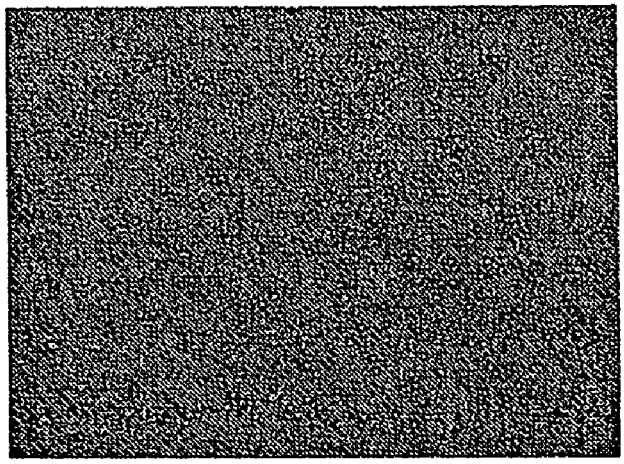
FIGS. 18A and 18B are photographic images of the emulsion indicated by the curve G9 in FIG. 11, taken at 100 and 400 magnifications, respectively.
Figure 18B:
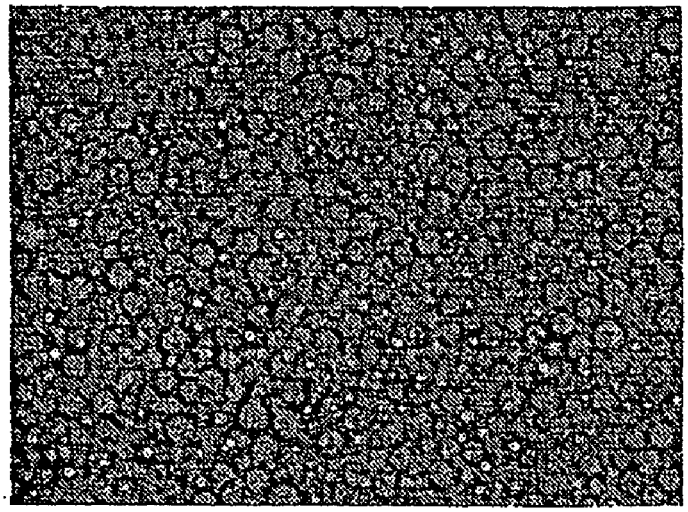

FIGS. 18A and 18B are photographic images of Sample 9 taken at 100 and 400 magnifications, respectively.

(10) Sample 10

Sample 10 was prepared the following conditions.

Agitating device: the agitating according to the present embodiment

Agitating speed: 7000 r.p.m.

Load: 70% of the rated value

Processing time: 5 minutes

The curve G10 in FIG. 11 indicates the particle-size distribution of dispersoid particles in Sample 10. While no macro bubble was formed in Sample 10, micro bubbles were formed therein.

Figure 19A:
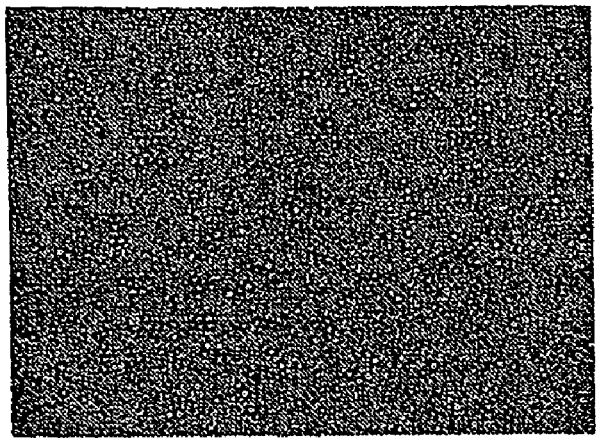
FIGS. 19A and 19B are photographic images of the emulsion indicated by the curve G10 in FIG. 11, taken at 100 and 400 magnifications, respectively.
Figure 19B:
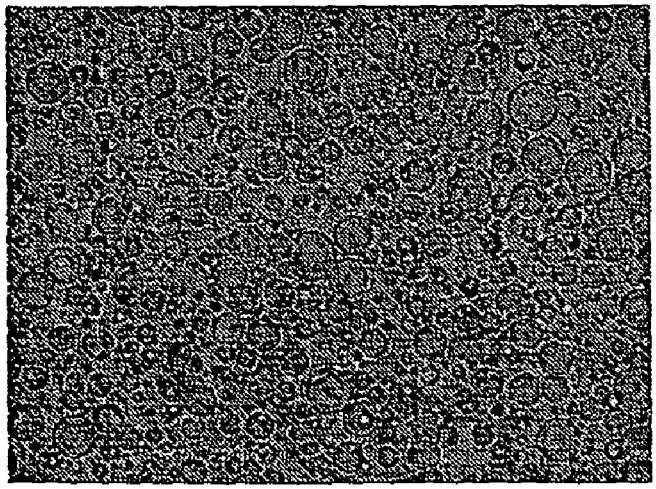

FIGS. 19A and 19B are photographic images of Sample 10 taken at 100 and 400 magnifications, respectively.

(11) Sample 11

Sample 11 was prepared the following conditions.

Agitating device: an agitating device including the blades of the conventional agitator and the multistage screen members according to the present embodiment Agitating speed: 10000 r.p.m.

Load: 60% of the rated value

Processing time: 5 minutes

The curve G11 in FIG. 11 indicates the particle-size distribution of dispersoid particles in Sample 11. Neither macro bubble nor micro bubble was formed in Sample 11.

Figure 20A:
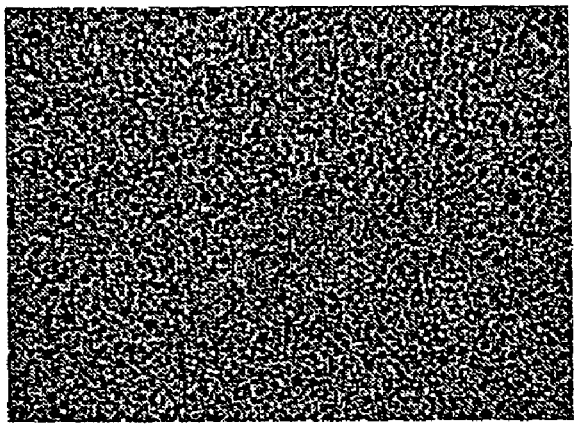
FIGS. 20A and 20B are photographic images of the emulsion indicated by the curve G11 in FIG. 11, taken at 100 and 400 magnifications, respectively.
Figure 20B:
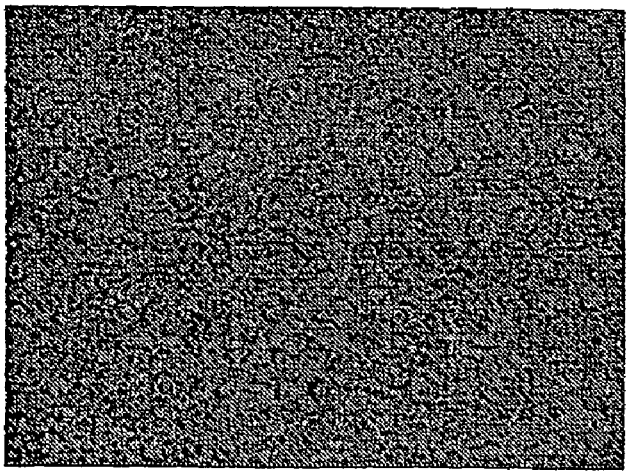

FIGS. 20A and 20B are photographic images of Sample 11 taken at 100 and 400 magnifications, respectively.

(12) Sample 12

Sample 12 was prepared the following conditions.

Agitating device: the conventional agitating device

Agitating speed: 10000 r.p.m.

Load: 70% of the rated value

Processing time: 5 minutes

Figure 21A:
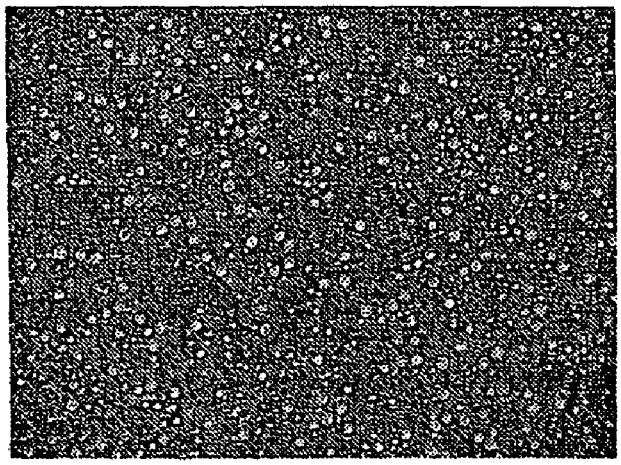
FIGS. 21A and 21B are photographic images of the emulsion indicated by the curve G12 in FIG. 11, taken at 100 and 400 magnifications, respectively, wherein a common element or component is defined by the same reference numeral.
Figure 21B:
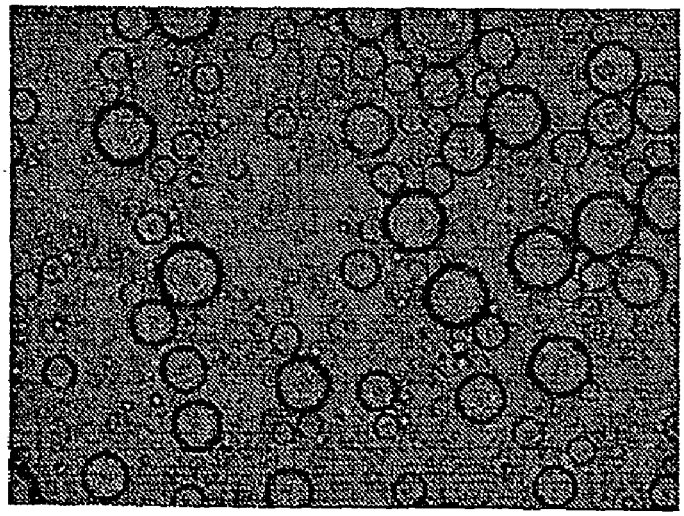

The curve G12 in FIG. 11 indicates the particle-size distribution of dispersoid particles in Sample 12. Macro bubbles and micro bubbles were formed in Sample 12. FIGS. 21A and 21B are photographic images of Sample 12 taken at 100 and 400 magnifications, respectively.

As seen in FIGS. 9 to 11 showing the measurement results of particle-size distribution, in Samples 1 and 2 (see the curves G1 and G2 in FIG. 9) and Samples 9 and 10 (see the curves G9 and G10 in FIG. 11) of emulsions prepared using the agitating device 3 or the homogenizer 1 according to the present embodiment, a particle having a particle diameter of 10μ or more is vanishingly reduced. This means that the formation of macro bubbles adversely affecting on the dispersion of a particle of 10μ or more is prevented. In contrast, each of Sample 5 (see the curve G5 in FIG. 9) and Sample 12 (see the curve G12 in FIG. 11) prepared using the conventional agitating device has a peak of the distribution ratio at a particle diameter of about 10μ. Thus, the agitating device 3 or the homogenizer 1 according to the present embodiment can substantially perfectly prevent the formation of macro bubbles to provide drastically enhanced dispersity of a dispersoid in a dispersion medium as compared with the conventional agitating device or homogenizer.

Even in Samples 3 and 4 (see the curves G3 and G4 in FIG. 9) and Sample 11 (see the curve G11 in FIG. 11) prepared using the agitating device including the blades of the conventional agitator and the multistage screen members according to the present embodiment, the distribution ratio is reduced at a particle diameter of about 10μ. In view of this measurement results, it is proved that the multistage screen members contribute significantly to preventing the formation of macro bubbles.

Further, as seen in FIG. 10, even in the cases where the emulsification using the high-pressure emulsifying apparatus is additionally performed after the high-speed agitating-based emulsification, Samples 6 and 7 (see the curves G6 and G7) prepared using the agitating device 3 according to the present embodiment has enhanced dispersity of the dispersoid as compared with Sample 8 (see the curve G8) prepared using the conventional agitating device. Thus, the agitating device 3 or the homogenizer 1 according to the present embodiment can also be effectively used with a high-pressure emulsifying apparatus.

Furthermore, as seen in FIGS. 12A to 21B, the dispersoid particles in the emulsions of Samples 1, 2, 6, 7, 9 and 10 prepared using the agitating device 3 or the homogenizer 1 according to the present embodiment have a smaller size than those in the emulsions of Samples 5, 8 and 12 prepared using the conventional agitating device. In view of these microscopic observation results, it is also proved that the agitating device 3 or the homogenizer 1 according to the present embodiment can substantially perfectly prevent the formation of macro bubbles to provide drastically enhanced dispersity of a dispersoid in a dispersion medium as compared with the conventional agitating device or homogenizer.

As mentioned above, according to the agitating device or the dispersing apparatus of the present invention, in a process of dispersing a dispersoid into a dispersion medium to form a dispersed system, a sufficiently high shearing force can be applied to a dispersion-material mixture. Further, in a process of forming a dispersed system using an open-to-atmosphere dispersing apparatus, the formation of macro babbles in a dispersion-material mixture can be effectively prevented.

While the present invention has been described in conjunction with the specific embodiments and examples, it will be understood by those skilled in the art that various changes and modifications may be made without departing from the spirit and scope of the invention. Accordingly, the present invention is not limited to such specific embodiment or examples, but the scope of the present invention should be determined by the following claims and their legal equivalents.

INDUSTRIAL APPLICABILITY

As above, the agitating device and the dispersing apparatus using the agitating device according to the present invention is useful, particularly, in forming a dispersed system, such as emulsion or suspension, and suitable for use in a homogenizer for forming an emulsion or a suspension, or the like.

The invention claimed is:

1. An agitating device comprising:

a first cover plate having a liquid inlet hole;

a second cover plate disposed at a position spaced apart from said first cover plate in a direction orthogonal to a spreading surface of said first cover plate;

a rotary impeller disposed at a position corresponding to said liquid inlet hole in a interplate space defined between said first and second cover plates;

an approximately tube-shaped or tub-shaped stationary inner screen member disposed in said interplate space so as to surround said impeller and formed with a plurality of elongate first liquid communication holes in a peripheral wall thereof, each of said first liquid communication holes extending in the directional orthogonal to said an reading surface; and at least one approximately tube-shaped stationary outer screen member disposed in said interplate space so as to surround said inner screen member and formed with a plurality of elongate second liquid communication holes in a peripheral wall thereof, each of said second liquid communication holes extending the direction orthogonal to said spreading surface.

wherein said elongate first and second liquid communication holes mostly eliminate a circumferential component of a flow vector of said mixture to allow said mixture to have substantially only a radial component.

2. The agitating device according to claim 1, wherein each of said peripheral walls of said inner and outer screen members has a cylindrical shape.

3. A dispersing apparatus of a batch-type comprising:

a batch-type vessel opened to the atmosphere and adapted to stock therein a mixture including a dispersoid and a dispersion medium; and an agitating device according to claim 1, which is disposed in said vessel to agitate said mixture stocked in said vessel so as to disperse said dispersoid into said dispersion medium to form a dispersed system in a batch manner.

4. The dispersing apparatus according to claim 3, wherein said dispersion medium is a liquid, and said dispersoid is a liquid or solid which is insoluble in said dispersion medium.

5. A dispersing apparatus of a continuous-type comprising:

a flow-type vessel closed to the atmosphere and adapted to allow a mixture including a dispersoid and a dispersion medium to flow therethrough; and an agitating device according to claim 1, which is disposed in said vessel to agitate said mixture flowing through said vessel so as to disperse said dispersoid into said dispersion medium to form a dispersed system in a continuous manner.

* * * * *

UNITED STATES PATENT AND TRADEMARK OFFICE

CERTIFICATE OF CORRECTION

PATENT NO. : 7,284,716 B2
APPLICATION NO. : 10/513440
DATED : October 23, 2007
INVENTOR(S) : Nakano et al.

It is certified that error appears in the above-identified patent and that said Letters Patent is hereby corrected as shown below:

Column 14, line 22: "to said an reading surface" should read --to said spreading surface--.
Column 14, line 28: "extending the direction" should read --extending in the direction--.
Column 14, line 29: "surface." should read --surface,--.

Signed and Sealed this

Twentieth Day of May, 2008

JON W. DUDAS
*Director of the United States Patent and Trademark Office*